US006672548B1

(12) United States Patent
Yates

(10) Patent No.: US 6,672,548 B1
(45) Date of Patent: Jan. 6, 2004

(54) CUSHION

(76) Inventor: Paul M. Yates, 5814 Briar Tree Dr., La Canada, CA (US) 91011

( * ) Notice: Subject to any disclaimer, the term of this patent is extended or adjusted under 35 U.S.C. 154(b) by 0 days.

(21) Appl. No.: 10/323,081

(22) Filed: Dec. 18, 2002

Related U.S. Application Data

(62) Division of application No. 09/728,455, filed on Dec. 1, 2000.

(51) Int. Cl.[7] ..... B43L 15/00
(52) U.S. Cl. ..... 248/118; 248/118.1; 264/112
(58) Field of Search ..... 264/112, 267, 264/268, 321; 248/118, 118.1; 156/918, 145; 400/715

(56) References Cited

U.S. PATENT DOCUMENTS 4,087,224 A * 5/1978 Moser ..... 425/388
4,089,919 A * 5/1978 Sanson ..... 264/46.6
4,115,170 A * 9/1978 Sanson ..... 156/79
4,116,736 A * 9/1978 Sanson et al. ..... 156/79
5,562,873 A * 10/1996 Tornero ..... 264/161
5,686,035 A * 11/1997 Tornero ..... 264/161
5,954,303 A * 9/1999 Wolf et al. ..... 248/118.3
6,068,808 A * 5/2000 Tornero ..... 264/316
6,286,903 B1 * 9/2001 Proux ..... 297/452.26
6,365,087 B2 * 4/2002 Tornero ..... 264/316

* cited by examiner

*Primary Examiner*—Leslie A. Braun
*Assistant Examiner*—Steven Marsh
(74) *Attorney, Agent, or Firm*—Walter A. Hackler

(57) ABSTRACT

A cushion includes a formed or stretchable sheet, or cover, and a core. The core includes individual and separate particulates and an oil for enabling lubricated movement of the particulates within the core in response to an outside force applied to the sheet. Particulates may include a combination of polymers and foam materials particularly open celled foam materials that may be partially filled with the oil upon forming of the cushion.

7 Claims, 2 Drawing Sheets

CUSHION

This application is a division of U.S. Ser. No. 09/728,455 filed Dec. 1, 2000.

The present invention generally relates to resilient cushions, and more particularly relates to a simulated gel core cushion and a method of manufacture.

A recent surge in the number of wrist and arm occupational injuries, resulting from repetitive computer keyboard use, has prompted the development of countless cushions directed at alleviating this modern problem. "Carpal Tunnel Syndrome" has become a well-known term describing a group of symptoms, including tendonitis, and epicondylitis, that occurs as a result of repetitive flexion of the wrist joints. Not only are the symptoms of Carpal Tunnel Syndrome extremely painful, they have the potential to be permanently debilitating. Fortunately, it has been found that if the causes of the disease are minimized or eliminated in time, further damage therefrom may be averted.

Some prior art wrist cushions, though designed to minimize repetitive wrist flexion, tend to be uncomfortable to use after a period of time. Notably, because such devices are typically positioned for supporting the underside of a user's wrist, flow of blood may be impeded by the use of rigid, non-yielding material.

Thus, a number of prior art wrist cushions are comprised of softer, more comfortable materials, such as foam rubber. Unfortunately, the resiliency of foam rubber, and other similar cellular materials, tends to diminish after extended periods of use. Furthermore, foam rubber tends to wear unevenly, resulting in hardened areas where compression is most regularly applied. Thus, foam rubber supports become less comfortable with time, necessitating frequent replacement thereof.

Cushioning devices having liquid or gel filled bladders have been developed in the attempt to provide a more comfortable, more durable support for the wrist than is possible with solid or foam rubber supports. For example, U.S. Pat. No. 5,435,508 discloses a wrist rest support comprising a viscous, fluid-filled bladder removably inserted in a machine washable outer covering.

Such liquid and gel cushions are manufactured by several independent steps, including sewing or other means of assembling the bladder, filling the bladder with the desired liquid, sealing the bladder such that it will resist leakage, and fashioning an outer covering in which to enclose the liquid filled bladder. It is clear that these procedures are time consuming and, as a result, expensive.

Gel cushion provide superior resilient characteristics, however, such gels, as for example, triblock polymer, are very expensive which limits their use.

The present invention provides a substantially less complicated process for manufacturing a comfortable resilient cushion that includes all the advantages of a gel cushion.

SUMMARY OF THE INVENTION

A cushion in accordance with the present invention generally includes a sheet, or cover, and a core disposed within the cover. The core includes a volume of individual separate particulates and a liquid, such as oil, disposed between the particulates for enabling lubricated movement of the particulates within the core in response to an outside force applied to the cover. The cover may be tensioned by the core into the selected contour or the cover may be preformed into the selected contour.

As a specific example, a cushion in accordance with the present invention may include a sheet that is stretched or tensioned in a selected contour, a backing, and a core disposed between the stretched sheet and the backing.

The core may comprise a mixture of compressible particulates and a liquid. This configuration provides gel like resilient characteristics. The liquid, which may be oil, is generally incompressible, however, compressible particulates mixed therewith provide, in combination, the "feel" of a gel cushion. That is, the mixture does not displace like a liquid but has an elastomer feel like a gel.

In one embodiment, the particulates may comprise open cell foam particles, and in this instance, the liquid may be at least partially disposed within the open cell foam particles. The particles, which may be partially filled with the liquid, remain compressible. The amount of open cell foam utilized is a factor in controlling the overall resilient "feel" of the resulting cushion.

In addition, this feature provides for the resiliency enabled by the foam yet less liquid is free to leak from the cushion if the stretchable sheet of backing is ruptured, pierced or cracked.

In addition, to further tailor the resiliency of the foam, polymer particulates may also be distributed as part of the core mixture.

The sheet may be a formed elastomer or, a separate elastomer layer may be provided between the sheet and the core in order to both prevent leakage of the liquid from the cushion in case the sheet is ruptured and to prevent sensing by a user through the sheet of the particulates in the core. In this manner, a gel-like cushion is provided without the use of expensive gel materials.

Accordingly, a cushion in accordance with the present invention generally includes the flexible sheet and the core is produced by providing a mold having a selected contour and disposing the stretchable sheet over the mold. A volume of a mixture comprising particulates and liquid is disposed into the mold onto an exposed side of the stretchable fabric and the volume is forced into the mold to stretch the sheet to the contour. The backing is sealed on a bottom of a cushion to trap the volume between the sheet and the backing.

One embodiment of the present invention, the stretchable sheet may comprise an elastomer and the elastomer may be preshaped to the contour before insertion into the mold in order to facilitate assembly of the cushion.

BRIEF DESCRIPTION OF THE DRAWINGS

The advantages and features of the present invention will appear from the following description when considered in conjunction with the accompanying drawings in which.

DETAILED DESCRIPTION

Figure 1:
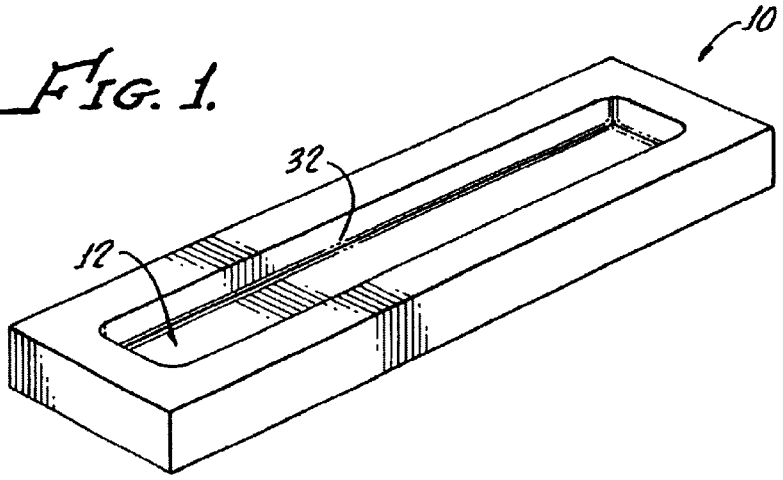
FIG. 1 is a mold suitable for use in forming the cushion in accordance with the present invention.

With reference to FIG. 1, there is shown a mold 10 having a cavity 12 suitable for use in manufacturing a cushion in accordance with the present invention.

Figure 2:
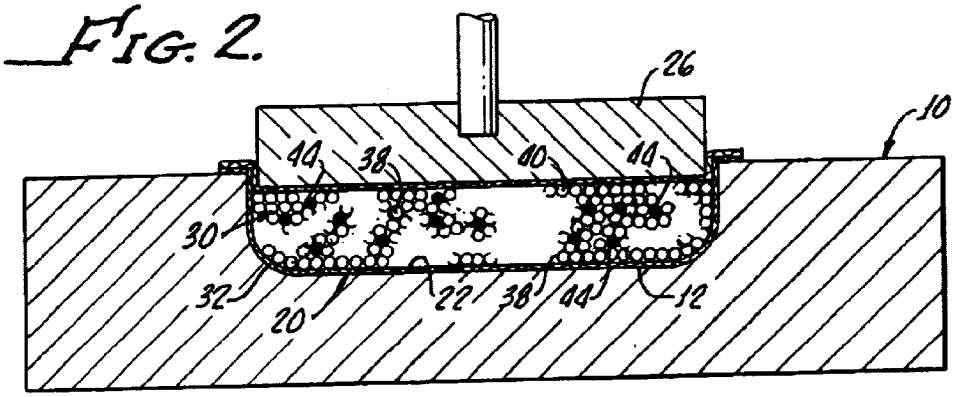
FIG. 2 is a cross-sectional view of the mold shown in FIG. 1 along with a ram for forcing the cushion within a mold cavity.
Figure 3:
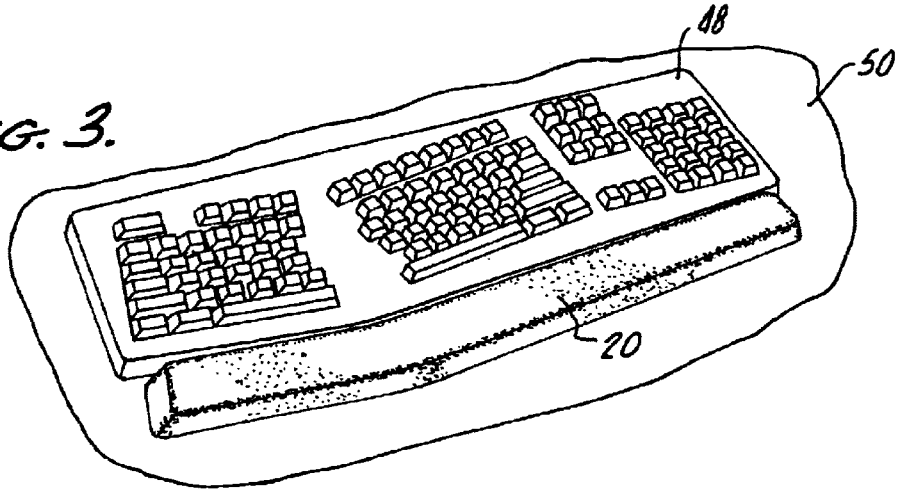
FIG. 3 is a perspective view of a cushion in accordance with the present invention as it may be used in conjunction with, for example, a computer keyboard.
Figure 4:
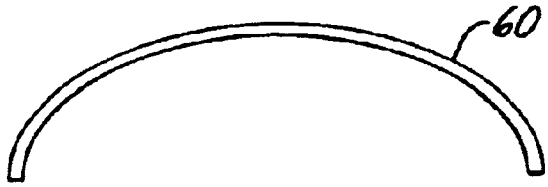
FIG. 4 is a cross-sectional view of a separate contoured elastomer that may be inserted between a sheet and a core of the present invention.
Figure 5:
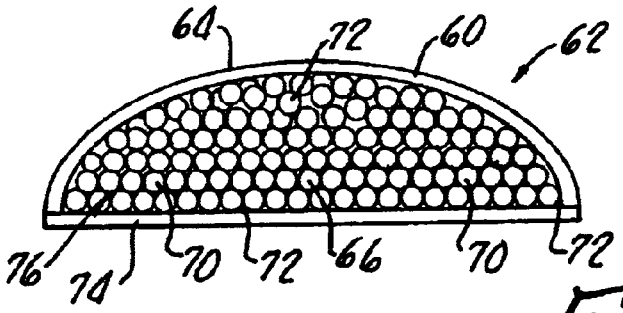
FIG. 5 is a cross-sectional view of a cushion utilizing the elastomer shown in FIG. 4 as it may be disposed between a stretched sheet and a core.

As shown in FIGS. 2, 3 a cushion 20 in accordance with the present invention may generally include a stretchable sheet, or cover, 22 and a core 30. The sheet may be made from any suitable material such as an elastomer, for example, a tri-block polymer. A separate elastomer may be utilized as shown in FIGS. 4–5. In this case the elastomer may have a thickness of between about 1/16 inches and about ½ inches and provide for a specific surface resiliency as desired.

The sheet 20 may be disposed over the cavity 12 and forced therein by a ram 26 along with a volume 36 of a mixture of particulates 38 and a liquid 40. The core 30 then supports the sheet 20 in the stretched selected contour 32.

The ram 26 may be heated, however, insufficient heat is provided to cause any fusing of the particulates 38 or any chemical polymerization thereof.

The particulates 38 should be compressible in order that in combination with the liquid 40, the cushion achieves gel like resilient characteristics. Any suitable compressible particulate 38 may be utilized, including but not limited to, closed and open cell foams. In the case of open cell foam particulates 38, the pressure of the ram forces the liquid, which may be oil, into the foam to form the core 30. Effectively, the liquid 40 is absorbed by the particulates 38.

As hereinabove noted, this enables a cushion 20 to have resilient characteristics similar to expensive gel cushions formed from, for example, tri-block co-polymer elastomer utilizing a plasticizing oil as described, for example, in U.S. Pat. No. 5,633,286.

To further customize the resiliency of the cushion 20, polymer particles 44 may be also be part of the core 30.

The cushion 20 may be formed from very inexpensive and recycled materials. Used plastic items (not shown) may be shredded i.e., particulated, along with shredded used foam pieces (not shown) in order to form the core 30 of the present invention. The combination of these particulates 44 and the liquid and particularly the use of a compressible foam particulate 38 enable the cushion 20, in accordance with the present invention, to exhibit gel-like qualities only achieved through the use of expensive tri-block polymer gels and the like hereinabove noted.

A typical use for the cushion 20 is shown in FIG. 3 in conjunction with a computer keyboard 48 disposed on a supporting surface 50. It should be appreciated that cushion 20 shown in conjunction with a computer keyboard is by way of example only. Any number of cushion products may be formed through the method of the present invention. These cushions (not shown) may vary from small hand cushions to large pillow cushions or larger resilient panels for any number of uses.

Accordingly, the types of particulates 38, 44, size of particulates 38, 44 and mixture of particulates 38, 44 between foam and polymer and the liquid 40, which may be oil, are varied to provide for the desired resiliency.

Specific polymers that are suitable for use with the present invention include neoprene in addition, foams such as urethane, or foamed tri-block polymers may be utilized as well as any number of liquids 40 such as water or oil.

As shown in FIGS. 4–5, a separate preformed elastomer layer 60 may be used in an alternative embodiment cushion 62. An elastomer 60 of thichnesses between about 1/16 inches and ½ inches may be disposed between a tensioned sheet 64 and a core 66 of particulate and liquid as hereinabove described.

Pressure to stretch the sheet 20 may also be created through the use of a foaming elastomer 72, shown in FIG. 5. The foaming elastomer 72 may be activated by a catalyst or heat after a backing 74 is applied. The foaming elastomer 72 may be added as a separate layer 76 and dispersed throughout the core 66.

The elastomer 60 used in this manner not only prevents leakage of any liquid if the sheet or skin 64 is pierced, ruptured or crushed, but also prevents a user (not shown) from sensing thorough the sheet 64, of particulates 70 within the core 66.

The particulates 70 are as hereinabove described in connection with the cushion 20 shown in FIG. 1–3. When particulate 70 have a size of between about 1/32 inches and 1 inch the elastomer 60 may have a thickness of between about 1/16 inches and about ½ inches.

Figure 6:
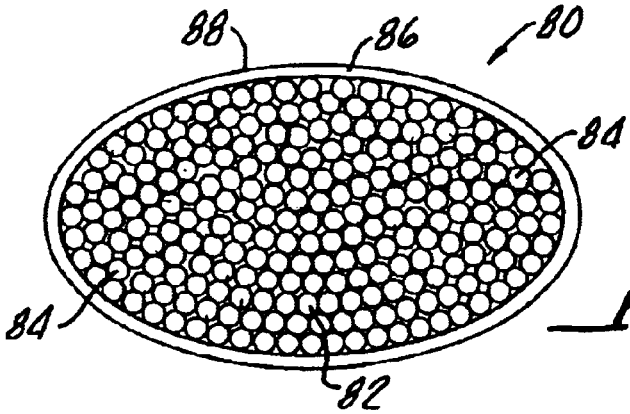
FIG. 6 is a cross-sectional view of an alternative embodiment of the present invention.

An additional cushion embodiment 80 is shown in FIG. 6 in which a core 82 of particulates and liquid 84 is encapsulated to an elastomer 86 and skin 88. This cushion 80 is similar to the cushion 62 shown in FIG. 5 except for its symmetric shape.

In accordance with the present invention, the core 82 may be relatively dry when using the thick elastomer 86 as long as the core 82 has an electrometric nature.

Although there has been hereinabove described a specific cushion for illustrating the manner in which the invention may be used to advantage, it should be appreciated that the invention is not limited thereto. Accordingly, any and all modifications, variations, or equivalent arrangements, which may occur to those skilled in the art, should be considered to be within the scope and spire of the present invention as defined in the appended claims.

What is claimed is:

1. A cushion comprising:

a stretchable sheet; and a core for supporting said stretchable sheet in a selected contour, the core produced by:

providing a mold having the selected contour;

disposing said stretchable sheet over the mold;

disposing a volume of a mixture comprising compressible open cell foam particles and a liquid into the mold onto an exposed side of said stretchable sheet;

forcing the volume into the mold and said liquid into the open cell foam particles; and sealing a backing over a bottom of the cushion to trap the volume between the sheet and the backing.

2. The cushion according to claim 1 wherein said stretchable sheet comprises an elastomer.

3. The cushion according to claim 2 wherein said elastomer is preshaped to the contour before insertion into said mold.

4. The cushion according to claim 1 further comprising an elastomer disposed between said core and said stretchable sheet.

5. The cushion according to claim 4 wherein said elastomer has sufficient thickness to prevent sensing of the particulates in the core through the sheet.

6. The cushion according to claim 5 wherein said mixture further comprises polymer particles.

7. The cushion according to claim 1 wherein said backing comprises a second stretchable sheet.

* * * * *